US005129575A

United States Patent [19]

Bryan

[11] Patent Number: 5,129,575

[45] Date of Patent: Jul. 14, 1992

[54] STACKABLE PACKAGE CAPABLE OF DIVISION

[76] Inventor: Robert M. Bryan, P.O. Box 35664, Edina, Minn. 55435

[21] Appl. No.: 781,298

[22] Filed: Oct. 23, 1991

Related U.S. Application Data

[63] Continuation-in-part of Ser. No. 744,981, Aug. 14, 1991.

[51] Int. Cl.[5] ..... B65D 5/42

[52] U.S. Cl. ..... 229/120.011; 229/120.01; 229/120.11; 229/915

[58] Field of Search ..... 229/120.01, 120.011, 229/120.11, 120.13, 915, 919, DIG. 11; 206/602

[56] References Cited

U.S. PATENT DOCUMENTS

| | | | |
|---|---|---|---|
| 2,684,178 | 7/1954 | Keeler | 229/120.18 |
| 2,697,544 | 12/1954 | Morand | 229/120.011 |
| 3,158,312 | 11/1964 | Simkins | 229/120.011 |
| 4,228,945 | 10/1980 | Wysocki | 229/120.011 |
| 4,913,291 | 4/1990 | Schuster | 229/120.11 |
| 4,932,534 | 6/1990 | Focke et al. | 229/120.011 |
| 4,998,615 | 3/1991 | Bryan | 229/919 |
| 5,039,002 | 8/1991 | Spaner | 229/DIG. 11 |

FOREIGN PATENT DOCUMENTS

| | | | |
|---|---|---|---|
| 1079540 | 4/1960 | German Democratic Rep. | 206/602 |
| 739899 | 11/1955 | United Kingdom | 206/602 |
| 1106269 | 3/1968 | United Kingdom | 206/602 |

*Primary Examiner*—Gary E. Elkins
*Attorney, Agent, or Firm*—Burd, Bartz & Gutenkauf

[57] ABSTRACT

A composite tray and stacker structure for packages of a plurality of identical paperboard and/or plastic containers supported in a tray for the purpose of providing compressive load-bearing capability to the package. The composite tray and stacker is composed essentially of a single sheet of stiff material, such as corrugated paperboard. The structure includes a rectangular tray bottom wall having a central transverse reverse fold line and a pair of end walls connected to the bottom wall along fold lines. A pair of top wall spacer elements are foldably connected along the top edges of the end walls and a pair of weight-bearing abutable stacker elements are foldably connected to the spacer elements. A relatively narrow product retainer panel is connected to each of the side edges of each of the end walls and stacker elements along fold lines. Relatively narrow rectangular flaps are connected along fold lines to the side edges of the bottom tray and in most instances also to the side edges of the top wall spacer elements. In the assembled package the end walls and spacer elements lie in parallel spaced apart relation to support packages stacked one on another. The rectangular flaps engage the outer surfaces of the product retainer panels. The assembled package encloses a pair of mirror image cells or compartments for product containers and is readily divisible into half packages.

19 Claims, 1 Drawing Sheet

STACKABLE PACKAGE CAPABLE OF DIVISION

This application is a continuation-in-part of my co-pending application Ser. No. 744,981, filed Aug. 14, 1991, pending.

FIELD OF THE INVENTION

Background of the Invention

This invention relates to a composite tray and stacker for packages of a plurality of identical paperboard and/or plastic containers supported in the tray for the purpose of providing compressive load-bearing capability to the package. The package of this invention is characterized by its capability of being divided into half packages and the elimination of need for shrink wrapping.

In my prior Pat. No. 4,998,615 and in my co-pending Application Ser. No. 644,962 there are disclosed shrink wrapped packages of a plurality of identical paperboard and/or plastic containers contained in a tray with a composite built-in stacker structure, and characterized by the efficiency and convenience of having the tray and stacker structure formed from a single piece of corrugated sheet material. Both forms of these packages are in widespread use and are eminently performing their intended functions.

In recent years there has been a proliferation of brands and varieties of products within a single brand. Examples are plain cereal, cereal with raisins, cereal with fruit and nuts, etc., and products which come in a variety of flavors Many smaller stores have difficulty coping with full cases of these products, creating demands for half cases. The same problem exists for some relatively slow moving products.

At the same time there is increasing concern with respect to environmentally safe disposal of plastic shrink wrap. Most smaller stores do not have a sufficient volume of shrink wrap to warrant accumulation for recycling. As a result most of it goes to landfills or is incinerated with unknown effect on ground water and air quality.

The present invention is directed to a stackable package constructed from a single piece of corrugated sheet material, which is readily divided into two halves, and which does not require the use of an outer shrink wrap to maintain the packaged product container within the package. The package of this invention is also adapted to use with heavy products, such as large sizes of liquids like milk, juices, etc., which are more readily handled in half size cartons.

The Prior Art

The prior art of record in my aforesaid Pat. No. 4,998,615 and applications Ser. No. 644,962 and No. 744,981 is incorporated herein by reference.

My co-pending application Ser. No. 744,981 is directed to a package of a plurality of identical paperboard and/or plastic containers contained in a tray with a composite built-in stacker structure. The composite tray and stacker structure includes a rectangular tray bottom wall having a central transverse reverse fold line with a pair of relatively wide rectangular end walls connected along their bottom edges to opposite ends of the tray bottom wall along spaced apart parallel fold lines The end walls are of a width approximately equal to the height of the containers to be packaged. A pair of rectangular top wall spacer elements are each connected along one edge to the top edge of each of the end walls along a fold line. A pair of rectangular weight-bearing stacker elements are each connected to one of the spacer elements along a fold line opposite from the spacer connection to the end walls. The width of the stacker elements is approximately equal to the width of the end walls. The stacker elements abut in the center of the package. A relatively narrow product retainer panel is connected to each of the side edges of each of the end walls and stacker elements along fold lines and fastening tabs are connected along fold lines to each end of the retainer panels. In the assembled package the fastening tabs engage the outer surfaces of the bottom tray and top walls.

The present invention represents a modification of and improvement over the package of application Ser. No. 744,981.

SUMMARY OF THE INVENTION

Sharing some of the structure of the package of application Ser. No. 744,981, the present invention is likewise directed to a package of a plurality of identical paperboard and/or plastic containers contained in a tray with a composite built-in stacker structure. The composite tray and stacker structure includes a rectangular tray bottom wall having a central transverse reverse fold line with a pair of relatively wide rectangular end walls connected along their bottom edges to opposite ends of the tray bottom wall along spaced apart parallel fold lines The end walls are of a width approximately equal to the height of the containers to be packaged A pair of rectangular top wall spacer elements are each connected along one edge to the top edge of each of the end walls along a fold line. A pair of rectangular weight-bearing stacker elements are each connected to one of the spacer elements along a fold line opposite from the spacer connection to the end walls. The width of the stacker elements is approximately equal to the width of the end walls. The stacker elements abut in the center of the package.

As in the earlier package, a relatively narrow product retainer panel is connected to each of the side edges of each of the end walls and stacker elements along fold lines. The fastening tabs of the earlier package are eliminated. Instead, there are provided relatively narrow rectangular flaps connected to the side edges of the bottom tray and in most instances also to the side edges of each of the top wall spacer element. In the assembled package these flaps fold over and are fastened to the product retainer panels.

BRIEF DESCRIPTION OF THE DRAWINGS

The invention is illustrated in the accompanying drawings in which corresponding parts are identified by the same numerals and in which:

FIG. 1 is a perspective view showing two typical packages according to the present invention stacked one upon the other;

DETAILED DESCRIPTION OF THE PREFERRED EMBODIMENT

Figure 3:
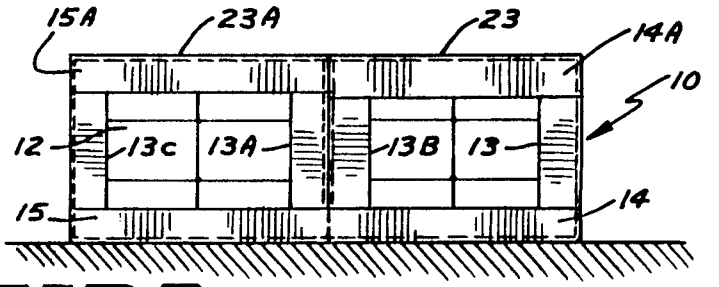
FIG. 3 is a front elevation of an assembled tray and stacker.
Figure 4:
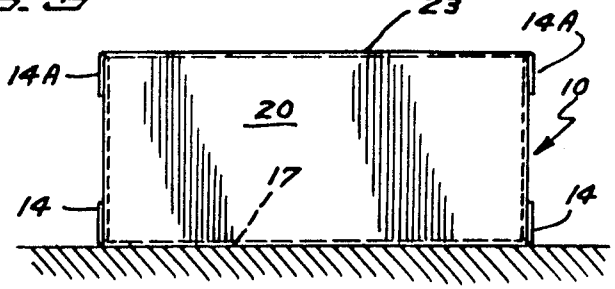
FIG. 4 is an end elevation thereof.

Referring now to the drawings, and particularly to FIG. 1, there is shown a pair of typical divisible packages according to the present invention, indicated generally at 10, stacked one upon the other. The package includes a flat tray portion and an integral stacker structure formed from a single sheet of stiff sheet material A plurality of identical paperboard and/or plastic product containers 12 are supported within the tray portion of the package. As explained in detail hereinafter, a plurality of relatively narrow product retainer panels 13–13C and flaps 14 and 14A and 15 and 15A hold the containers within the package, eliminating the necessity for a shrink plastic overwrap.

Although the divisible composite tray and stacker structure according to the present invention is intended for use without shrink wrapping packages, there may be circumstances in which shrink wrapping is desirable though unnecessary. For example, if the packages are to be exposed to a particularly dirty environment, protective shrink wrapping may be used. Even then a stack of unwrapped packages in a palletized load may be shrink wrapped as a unit, without the necessity of wrapping each individual package, to provide the desired protection.

Figure 2:
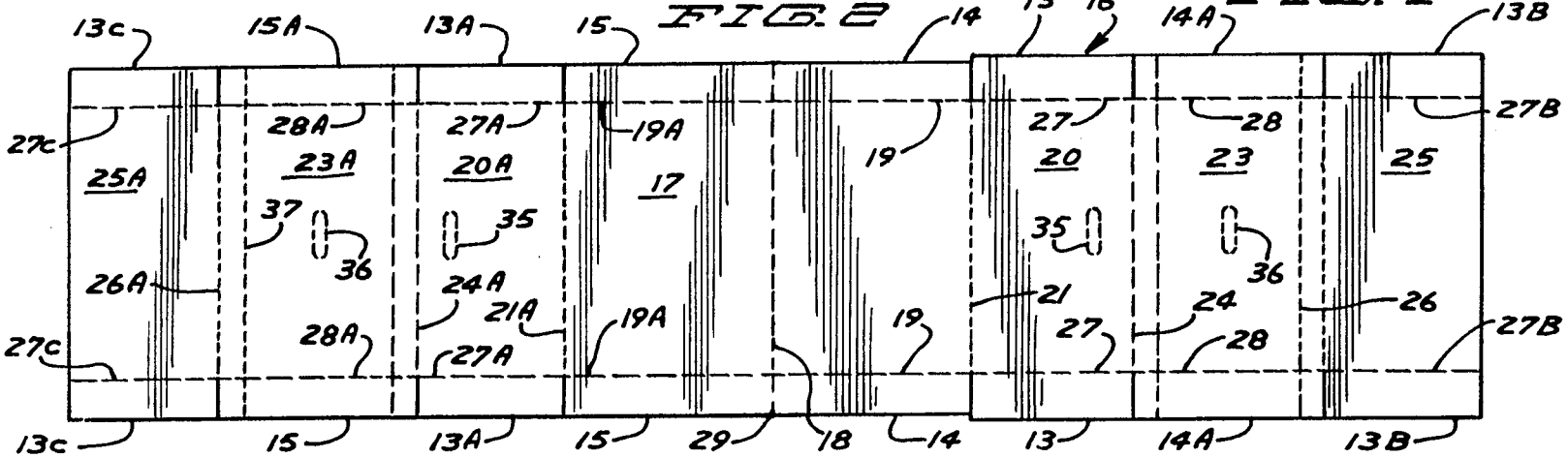
FIG. 2 is a plan view of a sheet material blank from which a divisible composite tray and stacker may be formed, showing optional hand-holds and tear strips which may be used.
Figure 7:
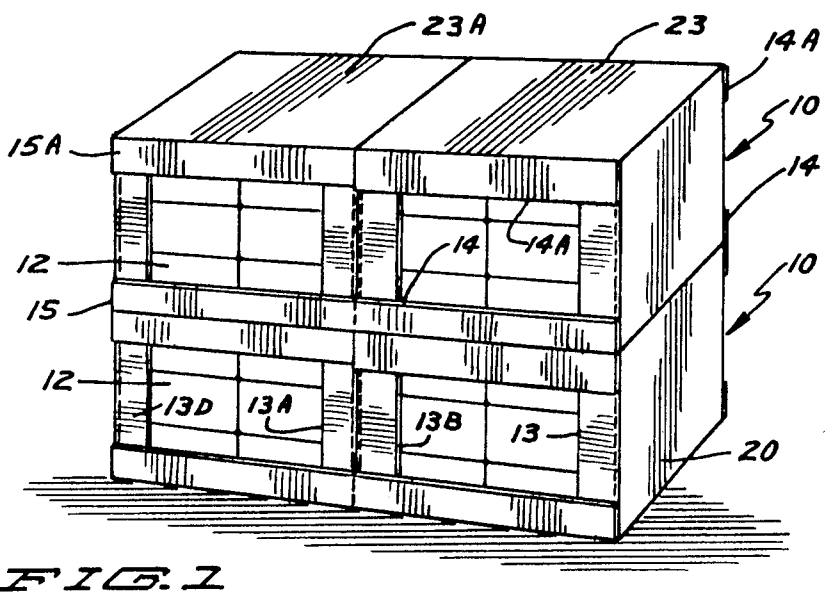

Referring to FIG. 2, there is shown a blank 16 from which the divisible composite tray and stacker is assembled. The blank includes a rectangular tray bottom wall section 17. To facilitate loading, tray bottom wall 17 has a central transverse fold line 18.

A pair of narrow rectangular flaps 14 (narrow relative to the width of bottom tray 17) are connected to opposite side edges of the bottom tray section, on one side of reverse fold line 18, along fold lines 19. Another pair of narrow rectangular flaps 15 are connected to opposite side edges of the bottom tray section, on the opposite side of reverse fold line 18, along fold lines 19A. Flaps 14 and 15 extend horizontally across the front and back faces of the assembled package along the bottom edge thereof Flaps 14 and 15 should preferably be joined along extensions of reverse fold line 18.

The end wall sections 20 and 20A of the blank are connected to the tray bottom wall portion along spaced apart parallel fold lines 21 and 21A, respectively. A pair of top wall spacer elements 23 and 23A are each connected along fold lines 24 and 24A, respectively, to the adjacent end wall sections 20 and 20A. A pair of stacker elements 25 and 25A are connected along fold lines 26 and 26A, respectively, to the next adjacent spacer elements 23 and 23A. The widths of the stacker elements 25 and 25A are approximately equal to the widths of the end wall portions 20 and 20A. The combined widths of the top wall spacer elements 23 and 23A are approximately equal to the length of the tray bottom wall section 17. This form of package is adapted to the packaging of containers 12 arrayed on the bottom wall of the tray in an even numbered series of rows.

The illustrated containers 12 are relatively flat rectangular boxes stacked in two rows of three boxes in each half of the package The containers may be vertically arrayed boxes; or cartons such as used to dispense liquids such as milk or juices; or jugs such as used to dispense milk, distilled water, juices, etc., or bottles used to dispense cooking and lubricating oils, shampoos, detergents, etc.; deodorant containers, toothpaste pumps, and the like. Large containers may be shipped in packages of only four, or even two, containers per package.

A pair of relatively narrow rectangular product retainer panels 13 and 13A, which extend vertically in the assembled package, are co-extensive with each side edge of both end wall sections 20 and 20A, respectively, and are connected to the end walls by fold lines 27 and 27A, respectively. Similarly, a pair of like retainer panels 13B and 13C are co-extensive with each side edge of both stacker elements 25 and 25A, respectively, and are connected thereto by fold lines 27B and 27C, respectively.

Retainer panels 13–13C are each of a width no more than one fourth the length of the bottom tray wall 15. Depending upon the product to be packaged they may be only wide enough to securely retain the packaged containers within the assembled package. This leaves a substantial gap or window in each half face of the assembled package through which the packaged product is visible and may be displayed when the package itself is used as a display in lieu of shelving the containers. For some products it is desireable that the edges of the panels abut without overlapping.

A further pair of narrow rectangular flaps 14A and 15A, which extend horizontally across the front and back faces of the assembled package along the top edge thereof, are co-extensive with each side edge of both top wall spacer elements 23 and 23A, respectively, and are connected to the top walls by fold lines 28 and 28A, respectively It will be noted that the widths of product retainer panels 13B are preferably very slightly (about ¼ inch) wider than their counter-parts 13C. This facilitates the plow and tuck operations of the package making machine in the assembly of the package 14A and panels 13 may be slightly wider, as shown, but need not be.

Although flaps 14 and 15 are shown as separated only by a score line or perforation to facilitate separation of the divisible package, in some instances a slot may be provided between flaps 14 and 15 to facilitate assembly and separation of the package In most instances the width of flaps 14, 14A, 15 and 15A is necessarily no more than one half the width of end walls 20 and 20A and stacker elements 25 and 25A. Preferably they are only wide enough to securely retain the packaged containers within the assembled package. As in the case of retainer flaps 13–13C, and in cooperation therewith, this may leave a substantial gap or window in each half face of the assembled package through which the packaged product is visible and may be displayed when the package itself is used as a display in lieu of shelving the containers, or the ends of the packages may be substantially closed. Increasingly it is required that a UPC (Universal Product Code) be applied to each side of a package. Flaps 14 and 15 are preferably wide enough to receive the UPC.

In assembling the package, the end walls 20 and 20A are folded along fold lines 21 and 21A, respectively, to extend vertically relative to the horizontal tray bottom wall 17. The stacker elements 25 and 25A are folded along fold lines 26 and 26A, respectively, to extend at right angles to the top wall spacer elements 23 and 23A which are folded along fold lines 24 and 24A, respectively, to extend horizontally at right angles relative to the top edges of the side walls 20 and 20A. To facilitate insertion of the stacker elements 25 and 25A between adjacent rows of containers 12, reverse fold line 18 permits slight bumping of the tray bottom wall and separation of the tops of the containers. A narrow bead or strip of glue or other adhesives as are commonly used in the packaging industry may be applied to the top edge of one of stacker elements 25 or 25A along fold line 27 or 27A to secure the stacker elements in face-to-face abutting relation, but permitting later separation to divide the assembled package into halves. Where the overall height of the package is relatively small as compared to the width of flaps 14 and 15 and the flaps are joined at their ends, then the use of adhesive may not be necessary.

Retainer panels 13–13C are folded inwardly along fold lines 27–27C, respectively. Flaps 14 and 15 are folded inwardly and upwardly along fold lines 19 and 19A, respectively, and are secured by glue or other adhesive to the outside surfaces of panels 13–13C adjacent to the bottom edges thereof. Flaps 14A and 15A are folded inwardly and downwardly along fold lines 28 and 28A, respectively, and are secured to the outside surfaces of panels 13–13C adjacent to the top edges thereto.

In so assembling the package, the weight-bearing stacker elements 25 and 25A extend vertically downwardly to the tray bottom wall. The combination of the abutting stacker elements 25 and 25A along with side walls 20 and 20A, both strengthened by retainer panels 13–13C, permits stacking of packages on top of the package top wall formed by spacer elements 23 and 23A. The packaged containers are securely held in the mirror image cells defined by the bottom tray 17, top wall spacers 23 and 23A, end walls 20 and 20A, stacker elements 25 and 25A, retainer panels 13–13C, and flaps 14, 15, 14A and 15A..

Upon arrival at the distribution point for the packaged containers, if customer requirements so demand, the packages are easily divisible into halves. The abutting stacker elements 25 and 25A are readily separated by tearing apart the narrow glue line joining them at their top edges. A cut may be made along the reverse fold line 18, or preferably the reverse fold line is perforated to permit easy separation of the bottom tray 17. In this manner retailer demands for half cartons of products can be satisfied while maintaining the integrity of the packages until they reach their final destination.

The relative sizes and proportions of the various package components: bottom tray, end walls, top walls, stackers, retainer panels, and flaps, depend upon the products to be packaged and the number of units to be enclosed in a single package Where the products are heavy hand-holds 35 may optionally be provided in the end walls 20 and 20A, either by whole or partial die cuts or perforations, to facilitate handling of the packages Similarly, hand-holds 36 may optionally be provided in the center of the top walls 23 and 23A to facilitate carrying of relatively bulky and heavy products as gallon sizes of milk or juices, or the like. These products may be purchased by the ultimate consumer in half cartons, and taken home without the necessity of opening the package In some instances a twin-pack may be desirable. In this case the hand-holds are located closely spaced apart on opposite sides of the seam formed by the abutting spacer elements.

Where the height of the product to be packaged is relatively small, such as cans of meat spreads, Vienna sausages, tuna, jars of pimentos, and the like, the top flaps 14A and 15A may be elminated. Then the width of lower flaps 14 and 15 may be equal to the height of the packaged product In this way the upturned bottom flap in combination with the retainer panels forms the closure for the package.

Where the packaged product may be sold to the consumer without removal from the package and shelving, transverse perforations 37 are provided in the top wall spacer elements 23 and 23A and attached flaps 14A and 15A, spaced inwardly from fold lines 24, 24A, 26 and 26A by a distance about equal to the width of retainer panels 13–13C. When the package reaches the sales floor the panel between perforations 37 can readily be removed by tearing the perforations, converting the package into a display from which the product containers are easily removed by the purchaser.

The blank 16 is composed essentially of stiff sheet material, such as corrugated cardboard as is commonly used in the packaging industry. Ordinarily, where the packages are intended to be stored with the trays disposed horizontally and stacked one on top of the other, the corrugations extend vertically for maximum strength Blank 16 is die cut from corrugated stock with minimum waste. That minimum waste is recyclable.

It is apparent that many modifications and variations of this invention as hereinbefore set forth may be made without departing from the spirit and scope thereof The specific embodiments described are given by way of example only and the invention is limited only by the terms of the appended claims.

I claim:

1. A composite tray and stacker structure for a divisible stackable package of a plurality of identical containers, said structure having inside and outside surfaces and comprising:

A) a rectangular tray bottom wall having side and end edges;

B) a central transverse reverse fold line across the tray bottom wall;

C) a pair of rectangular end walls having top, bottom and side edges, said end walls being connected along heir bottom edges to opposite ends of said bottom wall along spaced apart parallel fold lines, said end walls being of a width approximately equal of he height of the containers to be packaged;

D) a relatively narrow product retainer panel coextensive with and connected to each side edge of both of said end walls, each connected along a fold lien at the respective side edges of the end walls, said retainer panels being of a width no more than one fourth the length of said bottom tray wall;

E) a pair of rectangular spacer elements comprising the top walls of said package, said spacer elements having front, back and nd edges, each of said spacer elements being connected along one end edge to one of said end walls along a fold line at the top edge of each of the end walls; the total width of said spacer elements being equal to the length of the bottom tray;

F) a pair of rectangular weight-bearing stacker elements each connected to one of said spacer elements along a fold line along the edge thereof which is opposite from the end edge connecting the spacer element to the end wall, the width of said stacker elements being approximately equal to the width of the end walls;

G) a relatively narrow product retainer panel coextensive with and connected to each side edge of both of said stacker elements, each being connected along a fold line at the respective side edges of the stacker elements, said retainer panels being of a width no more than one fourth the length of said bottom tray wall; and H) relatively narrow flaps of width no more than the widths of the side walls and stacker elements, said flaps being co-extensive with and connected to each side edge of said tray bottom wall along fold lines at the side edges of the bottom wall, said flaps having ends and being in adjacent end-to-end abutment.

2. A composite tray and stacker structure according to claim 1 wherein:

A) said flaps connected to said tray bottom wall are of a width no more than one half the width of said end walls and stacker elements; and B) further relatively narrow flaps are provided co-extensive with and connected to each side edge of each of said top wall spacer elements along fold lines at the side edges of said spacer elements, said further flaps being of a width no more than one half the width of said end walls and stacker elements 3. A composite tray and stacker structure according to claim 1 wherein said reverse fold line is perforated.

4. A composite tray and stacker structure according to claim 1 wherein said flaps connected to the tray bottom wall are connected at (their adjacent ends), and are divided by perforations in alignment with said reverse fold line.

5. A composite tray and stacker structure according to claim 1 wherein said product retainer panels connected to the stacker element at one end of the structure are about one quarter inch wider than the retainer panels connected to the stacker element at the other end of said structure.

6. A composite tray and stacker structure according to claim 1 wherein a die cut or perforated hand-hold is provided in each of said top wall spacer elements 7. A composite tray and stacker structure according to claim 1 wherein a die cut or perforated hand-hold is provided in each of said end walls midway between the retainer panels connected thereto and spaced from the fold line between the end walls and top wall stacker elements.

8. A composite tray and stacker structure according to claim 1 wherein a pair of transverse parallel spaced apart lines of perforations are provided in each of said top wall spacer elements extending between the edges front and back of the top wall elements and spaced inwardly from the fold lines connecting the top wall elements to the end walls and stacker elements 9. A composite tray and stacker structure according to claim 1 wherein:

A) said end walls, top wall spacer elements and stacker elements are folded inwardly to bring the stacker elements into face-to-face abutment; and B) said stacker elements, in face-to-face abutment, are connected in an adhesive seam immediately adjacent to the fold lines between the stacker elements and top wall spacer elements 10. A composite tray and stacker structure according to claim 1 wherein:

A) said end walls, top wall spacer elements and stacker elements are folded inwardly to bring the stacker elements into face-to-face abutment;

B) the retainer panels are turned inwardly; and

C) the flaps are turned inwardly over the retainer panels and are adhesively secured at (their ends) to (the outside surfaces) of the retainer panels.

11. A composite tray and stacker structure according to claim 1 wherein said structure is comprised of corrugated board, the corrugations of which extend parallel to the direction of the bottom wall side edges, whereby the package has maximum load-bearing capability when stacked with its bottom wall horizontal.

12. In combination:

A) a composite tray and stacker structure according to claim 10; and

B) a plurality of identical product containers supported on the bottom wall of the tray between the side edges and end walls thereof, the stacker elements separating said containers into an equal number of containers 13. A combination according to claim 12 wherein said reverse fold line is perforated.

14. A combination according to claim 12 wherein said flaps connected to the tray bottom wall are connected at their adjacent ends, and are divided by perforations in alignment with said reverse fold line.

15. A combination according to claim 12 wherein said product retainer panels connected to the stacker element at one end of the structure are about one quarter inch wider than the retainer panels at the other end of said structure.

16. A combination according to claim 12 wherein a die cut or perforated hand-hold is provided in each of said top wall spacer elements.

17. A combination according to claim 12 wherein a die cut or perforated hand-hold is provided in each of said end walls midway between the retainer panels connected thereto and spaced from the fold line between the respective end walls and top wall spacer elements 18. A combination according to claim 12 wherein a pair of transverse parallel spaced apart lines of perforations are provided in each of said top wall spacer elements extending between the front and back edges of the top wall elements and spaced inwardly from the fold lines connecting the top wall elements to the end walls and stacker elements.

19. A combination according to claim 12 wherein said structure is comprised of corrugated board, the corrugations of which extend parallel to the direction of the bottom wall side edges, whereby the package has maximum load-bearing capability when stacked with its bottom wall horizontal.

* * * * *

UNITED STATES PATENT AND TRADEMARK OFFICE

CERTIFICATE OF CORRECTION

PATENT NO. : 5,129,575

DATED : July 14, 1992

INVENTOR(S) : ROBERT M. BRYAN

It is certified that error appears in the above-identified patent and that said Letters Patent is hereby corrected as shown below:

Col. 1, line 31 after "flavors" insert ---.---

Col. 1, line 65 after "lines" insert ---.---

Col. 2, line 31 after "lines" insert ---.---

Col. 2, line 33 after "packaged" insert ---.---

Col. 2, line 50 "element" should be "elements---

Col. 3, line 9 after "material" insert ---.---

Col. 3, line 43 after "thereof" insert ---.---

Col. 3, line 63 after "package" insert ---.---

Col. 4, line 30 after "respectively" insert ---.---

Col. 4, line 34 after "package" insert ---.---

Col. 4, line 41 after "package" insert ---.---

Col. 4, line 68 "bumping" should be ---humping---

Col. 5, line 49 after "package" insert ---.---

Col. 5, line 52 after "packages" insert ---.---

Col. 5, line 59 after "package" insert ---.---

Col. 5, line 68 after "product" insert ---.---

Col. 6, line 20 after "strength" insert ---.---

UNITED STATES PATENT AND TRADEMARK OFFICE

CERTIFICATE OF CORRECTION

PATENT NO. : 5,129,575

DATED : July 14, 1992

INVENTOR(S) : ROBERT M. BRYAN

It is certified that error appears in the above-identified patent and that said Letters Patent is hereby corrected as shown below:

Col. 6, line 24 after "thereof" insert ---.---

Col. 6, line 39 "heir" should be ---their---

Col. 6, line 42 "of he" should be ---to the---

Col. 6, line 46 "lien" should be ---line---

Col. 6, line 50 "walls" should be ---wall---

Col. 6, line 51 "nd" should be ---end---

Col. 7, line 21 after "elements" insert ---.---

Col. 7, line 38 after "elements" insert ---.---

Col. 7, line 48 before "edges" insert ---front and back--- and after "edges" delete ---front and back---

Col. 7, line 52 after "elements" insert ---.---

Col. 8, line 2 after "elements" insert ---.---

Col. 8, line 25 after "containers" insert ---.---

UNITED STATES PATENT AND TRADEMARK OFFICE

CERTIFICATE OF CORRECTION

PATENT NO. : 5,129,575
DATED : July 14, 1992
INVENTOR(S) : Robert M. Bryan

It is certified that error appears in the above-indentified patent and that said Letters Patent is hereby corrected as shown below:

Col. 8, line 45 after "elements" insert ---.---

Signed and Sealed this

Seventh Day of September, 1993

Bruce Lehman

*Attest:*

BRUCE LEHMAN

*Attesting Officer*

*Commissioner of Patents and Trademarks*